US010029457B2

(12) United States Patent
Ng et al.

(10) Patent No.: US 10,029,457 B2
(45) Date of Patent: Jul. 24, 2018

(54) PRE-CHARGE LINE ROUTED OVER PRE-CHARGE TRANSISTOR

(71) Applicant: HEWLETT-PACKARD DEVELOPMENT COMPANY, L.P., Houston, TX (US)

(72) Inventors: Boon Bing Ng, Singapore (SG); Thida Ma Win, Singapore (SG); Ning Ge, Palo Alto, CA (US); Jose Jehrome Rando, Salisbury Downs (AU)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/327,774

(22) PCT Filed: Jul. 30, 2014

(86) PCT No.: PCT/US2014/048931

§ 371 (c)(1),
(2) Date: Jan. 20, 2017

(87) PCT Pub. No.: WO2016/018316

PCT Pub. Date: Feb. 4, 2016

(65) Prior Publication Data

US 2017/0210124 A1 Jul. 27, 2017

(51) Int. Cl.
*B41J 2/045* (2006.01)

(52) U.S. Cl.
CPC ..... *B41J 2/0455* (2013.01); *B41J 2/0458* (2013.01); *B41J 2/04581* (2013.01)

(58) Field of Classification Search
CPC ..... B41J 2/0455; B41J 2/04581; B41J 2/0458
See application file for complete search history.

(56) References Cited

U.S. PATENT DOCUMENTS 6,481,817 B1 11/2002 Torgerson et al.
6,893,104 B2 5/2005 Tamura
8,109,586 B2 * 2/2012 Benjamin ..... B41J 2/04541 347/12

(Continued)

FOREIGN PATENT DOCUMENTS

CN 1350924 5/2002
CN 1972804 A 5/2007

(Continued)

*Primary Examiner* — Geoffrey Mruk
(74) *Attorney, Agent, or Firm* — Fabian VanCott

(57) ABSTRACT

A nozzle firing cell may comprise a firing transistor and a pre-charge transistor having a source and drain coupled between a pre-charge line and a gate of the firing transistor wherein the pre-charge line is routed over the gate of the pre-charge transistor. A fluid ejection device may comprise a circuit comprising a nozzle firing cell, the nozzle firing cell comprising a firing transistor and a pre-charge transistor having a source and drain coupled between a pre-charge Sine and a gate of the firing transistor in which the pre-charge line is routed over the gate of the pre-charge transistor. A circuit may comprise a number of firing transistors and a number of pre-charge transistors each having a source and drain coupled between a pre-charge line and a gate of one of the firing transistors in which the pre-charge line is routed over each of the gates of the pre-charge transistors.

20 Claims, 3 Drawing Sheets

(56) References Cited

U.S. PATENT DOCUMENTS

| | | | |
|---|---|---|---|
| 2004/0113959 | A1 | 6/2004 | Tamura |
| 2005/0230493 | A1 | 10/2005 | Benjamin et al. |
| 2007/0291061 | A1 | 12/2007 | Hu et al. |
| 2009/0046117 | A1 | 2/2009 | Benjamin |
| 2009/0058896 | A1 | 3/2009 | Benjamin |
| 2011/0080454 | A1 | 4/2011 | Ghozeil et al. |

FOREIGN PATENT DOCUMENTS

| | | | |
|---|---|---|---|
| CN | 101784392 | | 7/2010 |
| CN | 101848813 | | 9/2010 |
| CN | 101939169 | A | 1/2011 |
| CN | 102307731 | | 1/2012 |
| TW | 200533525 | A | 10/2005 |
| WO | WO2010/068192 | A1 | 6/2010 |

* cited by examiner

PRE-CHARGE LINE ROUTED OVER PRE-CHARGE TRANSISTOR

BACKGROUND

A firing cell is part of a circuit that sends a signal to a nozzle in an inkjet pen. When the signal is received, an actuator associated with the nozzle may cause an amount of fluid to be ejected from the nozzle.

BRIEF DESCRIPTION OF THE DRAWINGS

The accompanying drawings illustrate various examples of the principles described herein and are a part of the specification. The illustrated examples are given merely for illustration, and do not limit the scope of the claims.

Throughout the drawings, identical reference numbers designate similar, but not necessarily identical, elements.

DETAILED DESCRIPTION

Figure 1:
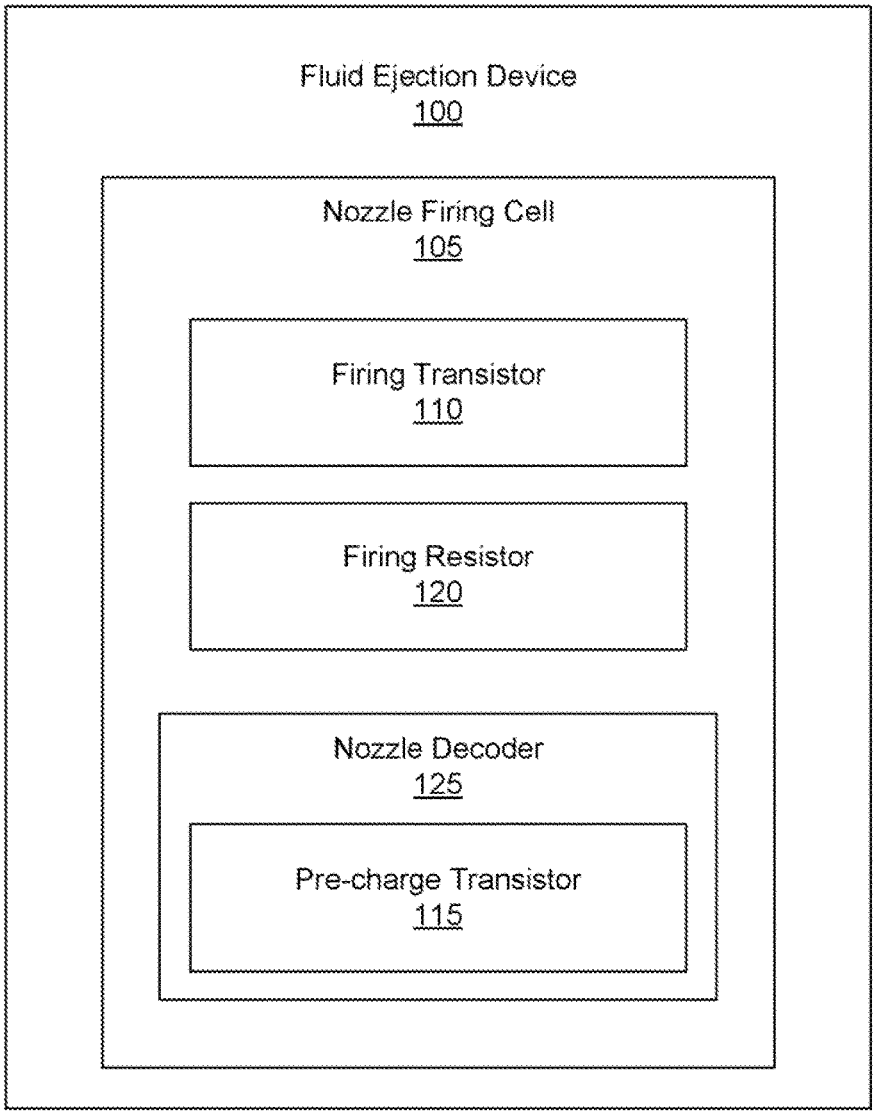
FIG. 1 is a block diagram of a fluid ejection device comprising a nozzle firing cell according to one example of the principles described here.

As briefly discussed above, the firing cell is part of a circuit called a nozzle firing cell and may be located within a printhead that provides a signal to an actuator associated with the nozzle. When the actuator receives the signal, it causes an amount of fluid to be ejected from the nozzle. The actuator, in one example, may be a thermal resistor. In this example, the thermal resistor, upon receiving the signal, may heat up and cause the fluid within a chamber associated with the nozzle to boil. The increase in pressure causes the fluid to be ejected through the nozzle. In another example, the actuator is a piezoelectric material. In this example, the piezoelectric material, upon receiving the signal, deforms and causes additional pressure in the chamber. The pressure in the chamber causes an amount of fluid to be ejected from the nozzle.

As a consequence of every nozzle being paired with its own nozzle firing cell, the size of the printhead die on which all nozzle firing cells are placed also increase with every nozzle that is formed on the die. This increases the footprint of the nozzle firing cell logic for all the nozzles and may further increase the size of the printhead as well.

The present specification, therefore, describes a nozzle firing cell comprising a firing transistor and a pre-charge transistor having a source and drain coupled between a pre-charge line and a gate of the firing transistor in which the pre-charge line is routed over the gate of the pre-charge transistor.

The present specification also describes a fluid ejection device comprising a circuit comprising a nozzle firing cell, the nozzle firing cell comprising a firing transistor and a pre-charge transistor having a source and drain coupled between a pre-charge line and a gate of the firing transistor in which the pre-charge line is routed over the gate of the pre-charge transistor.

The present specification further describes a circuit comprising a number of firing transistors and a number of pre-charge transistors each having a source and drain coupled between a pre-charge line and a gate of one of the firing transistors in which the pre-charge line is routed over each of the gates of the pre-charge transistors.

As used in the present specification and in the appended claims, the term "fluid" is meant to be understood broadly as any substance that continually deforms (flows) under an applied shear stress. In one example, the fluid is an ink. In another example, the fluid is a heated polymer. In still another example, the fluid is a pharmaceutical.

Even still further, as used in the present specification and in the appended claims, the term "a number of" or similar language is meant to be understood broadly as any positive number comprising 1 to infinity; zero not being a number, but the absence of a number.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an example" or similar language means that a particular feature, structure, or characteristic described in connection with that example is included as described, but may not be included in other examples.

FIG. 1 is a block diagram of a fluid ejection device (100) comprising a nozzle firing cell (105) according to one example of the principles described here. The fluid ejection device (100) may be any type of ejection device that may cause an amount of fluid to be ejected from an orifice defined thereon. In one example, the fluid ejection device (100) is a printer cartridge. In this example, the printer cartridge comprises a fluid reservoir, a die, a flexible cable, conductive pads, and a memory chip comprising the nozzle firing cell (105). The flexible cable is adhered to the cartridge and contains traces that electrically connect the memory chip and die with the conductive pads.

The cartridge may be installed into a cradle that is integral to the carriage of a printer. When the cartridge is correctly installed, the conductive pads are pressed against corresponding electrical contacts in the cradle, allowing the printer to communicate with, and control the electrical functions of, the cartridge. For example, the fluid ejection device (100) may direct the nozzle firing cell (105) to conduct a firing sequence of a nozzle.

In another example, the fluid ejection device (100) may be a page-wide array. In this example, the nozzle firing cell (105) may be located off of the page-wide array. However, the fluid ejection device (100) may still send a signal to the nozzle firing cell (105) associated with the fluid ejection device (100) in order to cause a nozzle to fire.

A memory chip associated with the Fluid ejection device may also be included and may contain a variety of information including the type of fluid cartridge, the kind of fluid contained in the cartridge, an estimate of the amount of fluid remaining in the fluid reservoir, calibration data, error information, and other data. In one example, the memory chip may comprise information regarding when the cartridge should be maintained. The fluid ejection device (100) can take appropriate action based on the information contained in the cartridge memory, such as notifying the user that the fluid supply is low or altering printing routines to maintain image quality.

In yet another example, the fluid ejection device (100) may be a 3D printer. In this example, the fluid may be a building material that is selectively deposited onto a substrate in order to create a 3D object. In still another example, the fluid ejection device (100) may be a pharmaceutical dispenser. In this example, the substrate may be an edible substrate onto which the pharmaceutical dispenser dispenses a metered amount of pharmaceutical onto the edible substrate for a patient to consume.

The nozzle firing cell (105) comprises a firing transistor (110), a firing resistor (120), and a nozzle decoder (125) comprising a pre-charge transistor (115). The source and drain of the pre-charge transistor (115) may be communicatively coupled to a pre-charge line. The pre-charge line provides an electrical signal to the pre-charge transistor (115) in order to charge a memory node associated with the nozzle firing cell (105). In one example, the pre-charge line is physically routed over the gate of the pre-charge transistor (115). This provides the advantage of shrinking the nozzle firing cell (105) in size. In one example, the size of the nozzle firing cell is shrunk from 112 μm to 75 μm. The reduction of the size of nozzle firing cell (105) allows additional nozzle firing cells (105) to be incorporated into the fluid ejection device (100). With the ability to add more nozzle firing cells (105) to the fluid ejection device (100), additional nozzles may be incorporated into the fluid ejection device (100) allowing for better quality prints on the fluid ejection device.

Figure 2:
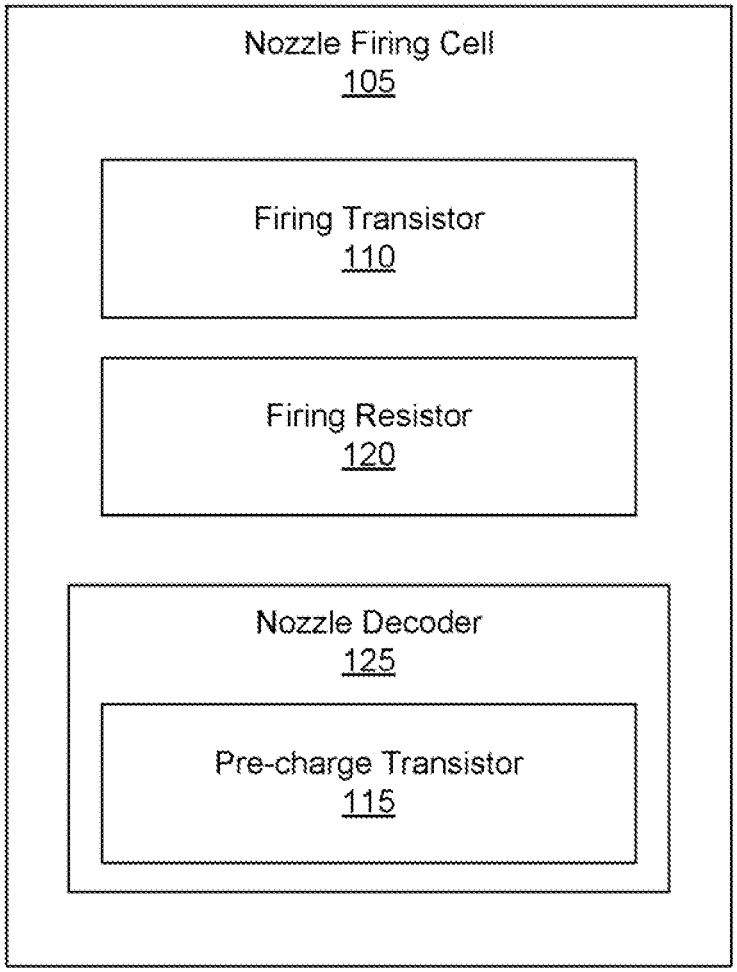
FIG. 2 a block diagram of a nozzle firing cell according to one example of the principles described here
Figure 3:
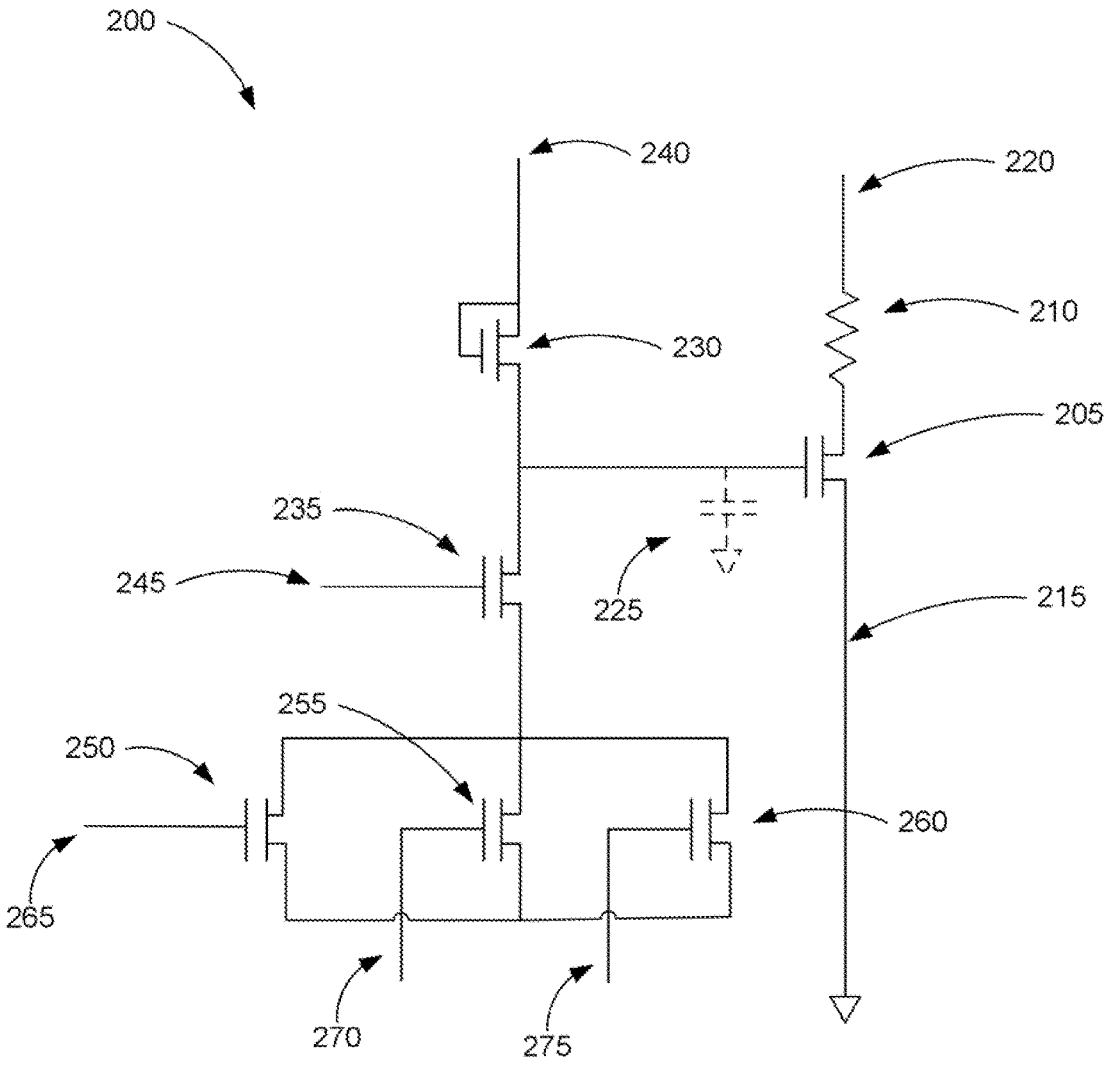
FIG. 3 is a schematic diagram of a nozzle firing cell according to one example of the principles described herein.

FIG. 2 is a nozzle firing cell (105) according to one example of the principles described here. As described above, the nozzle firing cell (105) comprises a firing transistor (110), a firing resistor (120), and a nozzle decoder (125) comprising a pre-charge transistor (115). The source and drain of the pre-charge transistor (115) may be communicatively coupled to a pre-charge line. The pre-charge line provides an electrical signal to the pre-charge transistor (115) in order to charge a memory node associated with the nozzle firing cell (105). In one example, the pre-charge line is physically routed over the gate of the pre-charge transistor (115). This provides the advantage of shrinking the nozzle firing cell (105) in size. In one example, the size of the nozzle firing cell is shrunk from 112 μm to 75 μm. The reduction of the size of nozzle firing cell (105) allows additional nozzle firing cells (105) to be incorporated into the fluid ejection device (100). With the ability to add more nozzle firing cells (105) to the fluid ejection device (100), additional nozzles may be incorporated into the fluid ejection device (100) allowing for better quality prints on the fluid ejection device FIG. 3 is a schematic diagram of a nozzle firing cell (200) according to one example of the principles described herein. The nozzle firing cell (200) includes a drive switch (205) electrically coupled to a firing resistor (210). In one example, the drive switch (205) is a FET including a drain-source path electrically coupled at one end to one terminal of firing resistor (210) and at the other end to a reference line (215). The reference line (215) is tied to a reference voltage, such as ground. The other terminal of firing resistor 210) is electrically coupled to a FIRE line (220) that delivers energy pulses to firing resistor (210). The energy pulses energize the firing resistor (210) if the drive switch (205) is on.

The gate of the drive switch (205) forms a storage node capacitance (225) that functions as a dynamic memory element to store data pursuant to the sequential activation of a pre-charge transistor (230) and a select transistor (235). The storage node capacitance (225) is shown in dashed lines, as it is part of the drive switch (205). Alternatively, a capacitor separate from the drive switch (205) can be used as a dynamic memory element.

The drain-source path and gate of the pre-charge transistor (230) are electrically coupled to a pre-charge line (240) that receives a pre-charge signal. As described above, the pre-charge line is physically layered over the pre-charge transistor (230). The gate of the drive switch (205) is electrically coupled to the drain-source path of the pre-charge transistor (230) and the drain-source path of the select transistor (235). The gate of the select transistor (235) may be electrically coupled to a select line (245) that receives a select signal. A pre-charge signal is one type of pulsed charge control signal. Another type of pulsed charge control signal is a discharge signal employed in examples of a discharged nozzle firing cell (200).

A data transistor (250), a first address transistor (255) and a second address transistor (260) include drain-source paths that are electrically coupled in parallel. The parallel combination of the data transistor (250), the first address transistor (255) and the second address transistor (260) is electrically coupled between the drain-source path of the select transistor (235) and reference line (215). The serial circuit including the select transistor (235) coupled to the parallel combination of the data transistor (250), the first address transistor (255) and the second address transistor (260) is electrically coupled across the node capacitance (225) of the drive switch (205). The gate of the data transistor (250) is electrically coupled to a latched data line (265) that receives a data signal. The gate of the first address transistor (255) is electrically coupled to an address line (270) that receives address signals and the gate of second address transistor (260) is electrically coupled to a second address line (275) that receives address signals. The data signals and address signals are active when low. The node capacitance (225), the pre-charge transistor (230), the select transistor (235), the data transistor (250), and the address transistors (255) and (260) form a memory cell that stores data and provides for the firing of the nozzles as described above.

In operation, the node capacitance (225) is pre-charged through the pre-charge transistor (230) by providing a high level voltage pulse on the pre-charge line (240). In one example, before or during the high level voltage pulse on the pre-charge line (240), a data signal may be provided on the data line (265) to set the state of the data transistor (250). Additionally, address signals are provided on the address lines (270) and (275) to set the states of the first address transistor (255) and the second address transistor (260). A high level voltage pulse is provided on the select line (245) to turn on the select transistor (235) and the node capacitance (225) discharges if the data transistor (250), the first address transistor (255), and/or the second address transistor (260) is on. Alternatively, the node capacitance (225) remains charged if the data transistor (250), the first address transistor (255), and the second address transistor (260 are all off.

As described above, the pre-charge line (240) physically runs over the pre-charge transistor (230). This precludes the use of a jumper of any kind including metal jumpers or polycrystalline silicon-jumpers. Silicone dies may be constructed having a number of different layers. A number of electrical connections may be run through a number of these layers in order to avoid having to implement a jumper or causing a short in the circuit. A jumper is a short length of conductor used to close a break in, or bypass part of, an electrical circuit. A side effect of using a jumper is the relatively lower voltage at the memory node according Kirchhoff Voltage Law (KVL). Lower voltage at a memory node will have an impact to the drive nozzle FET which will cause more energy loss during nozzle firing. This phenomenon is exasperated as the number of nozzles increase on the fluid ejection device (FIG. 1, 100). The above described nozzle firing cell (200) provides for a relatively more efficient pre-charge process because a jumper is not used on the pre-charge line (240). In this case, a jumper is not used because the pre-charge line (240) physically lies over the pre-charge transistor (230). As another advantage, the placement of the pre-charge line (240) physically over the pre-charge transistor (230) reduces the footprint of the circuit as a whole allowing additional nozzle firing cells (200) to be added to the circuit thereby allowing more nozzles to be added to the fluid ejection device (FIG. 1, 100). Additionally, as the number of nozzles and nozzle firing cells (200) increase, the efficiency of the pre-charge process in the entire circuit is improved.

A circuit may further be created comprising a number of the nozzle firing cells (FIG. 2, 105; FIG. 3, 200) described in FIGS. 2 and 3. Indeed, the fluid ejection device may comprise any number of nozzle firing cells (FIG. 2, 105; FIG. 3, 200) described in FIGS. 2 and 3 in order to control a number of nozzles on any given printhead or page-wide array. The advantage here is that with the decrease in size of each individual nozzle firing cell (FIG. 2, 105; FIG. 3, 200), the entire circuit comprising the nozzle firing cells (FIG. 2, 105; FIG. 3, 200) described in FIGS. 2 and 3 would also be smaller.

The preceding description has been presented to illustrate and describe examples of the principles described. This description is not intended to be exhaustive or to limit these principles to any precise form disclosed. Many modifications and variations are possible in light of the above teaching.

What is claimed is:

1. A nozzle firing cell comprising:
a firing transistor;
a firing resistor and
a decoder comprising a pre-charge transistor having a source and drain coupled between a pre-charge line and a gate of the firing transistor;
in which the pre-charge line is routed over the gate of the pre-charge transistor.

2. The nozzle firing cell of claim 1, in which a jumper is not used on the pre-charge line.

3. The nozzle firing cell of claim 1, in which the firing transistor comprises a source and drain coupled between a firing resistor and a reference voltage.

4. The nozzle firing cell of claim 1, further comprising a select transistor having a source and drain coupled between the pre-charge transistor and a parallel combination of a data transistor, a first address transistor, and a second address transistor.

5. The nozzle firing cell of claim 4, further comprising a memory node to store data pursuant to a sequential activation of the pre-charge transistor and the select transistor.

6. The nozzle firing cell of claim 4, further comprising a select line on which a voltage pulse is provided to turn on the select transistor:
wherein, when the select transistor is turned on, node capacitance at the firing transistor discharges when the data transistor and at least one of the address transistors is turned on.

7. The nozzle firing cell of claim 4, further comprising a select line on which a voltage pulse is provided to turn on the select transistor;
wherein, when the select transistor is turned on, node capacitance at the firing transistor remains charged when the data transistor, the first address transistor and the second address transistor are all turned off.

8. The nozzle firing cell of claim 1, wherein the gate of the firing transistor comprises a storage node capacitance that functions as a dynamic memory element to store data in response to the sequential activation of the pre-charge transistor and a select transistor coupled to both the pre-charge transistor and the gate of the firing transistor.

9. The nozzle firing cell of claim 1, further comprising a capacitor connected to a gate of the firing transistor to function as a dynamic memory element to store data in response to the sequential activation of the pre-charge transistor and a select transistor coupled to both the pre-charge transistor and the gate of the firing transistor.

10. The nozzle firing cell of claim 1, wherein the pre-charge line is physically layered in a different layer of a silicon-based circuit above the pre-charge transistor.

11. A fluid ejection device, comprising:
a circuit comprising a nozzle firing cell, the nozzle firing cell comprising:
a firing transistor;
a firing resistor; and
a decoder comprising a pre-charge transistor having a source and drain coupled between a pre-charge line and a gate of the firing transistor;
in which the pre-charge line is physically layered over the pre-charge transistor.

12. The fluid ejection device of claim 11, in which a jumper is not used on the pre-charge line.

13. The fluid ejection device of claim 11, in which the firing transistor comprises a source and drain coupled between a firing resistor and a reference voltage.

14. The fluid ejection device of claim 11, further comprising a select transistor having a source and drain coupled between a source and drain of the pre-charge transistor and a parallel combination of a data transistor, a first address transistor, and a second address transistor.

15. The fluid ejection device of claim 14, further comprising a memory node to store data pursuant to a sequential activation of the pre-charge transistor and the select transistor.

16. A circuit comprising:
a number of firing transistors;
a number of firing resistors; and
a number of decoders each comprising pre-charge transistors with each pre-charge transistor having a source and drain coupled between a pre-charge line and a gate of one of the firing transistors;
in which the pre-charge line is routed over a gate of each of the pre-charge transistors.

17. The circuit of claim 16, in which a jumper is not used on the pre-charge line.

18. The circuit of claim 16, in which each firing transistor comprises a source and drain coupled between a firing resistor and a reference voltage.

19. The circuit of claim 16, further comprising a number of select transistors each having a source and drain coupled between a source and drain of one of the pre-charge transistors and a parallel combination of a data transistor, a first address transistor, and a second address transistor.

20. The circuit of claim 19, further comprising a number of memory nodes to store data pursuant to a sequential activation of one of the pre-charge transistors and one of the select transistors.

* * * * *